United States Patent [19]

Cahill et al.

[11] 4,425,249

[45] Jan. 10, 1984

[54] BENZENE SULFONIC ACID CATALYZED AROMATIC MANNICH PRODUCTS FROM ALKYL PHENOLS

[75] Inventors: Paul J. Cahill, Wheaton, Ill.; Edmund J. Piasek, deceased, late of Chicago, Ill.; by Evelyn W. Hunt, administrator, Hoffman Estates, Ill.

[73] Assignee: Standard Oil Company (Indiana), Chicago, Ill.

[21] Appl. No.: 53,106

[22] Filed: Jun. 28, 1979

[51] Int. Cl.[3] ..... C10M 1/32

[52] U.S. Cl. ..... 252/51.5 R; 252/33; 252/47.5; 564/367; 564/368

[58] Field of Search ..... 252/33, 47.5, 51.5 R; 260/570, 5 P; 564/367, 368

[56] References Cited

U.S. PATENT DOCUMENTS

| | | | |
|---|---|---|---|
| 2,619,459 | 11/1952 | Neff | 252/33 |
| 2,962,442 | 11/1960 | Andress, Jr. | 252/51.5 R |
| 3,368,972 | 2/1968 | Otto | 252/51.5 R X |
| 3,539,633 | 11/1970 | Piasek et al. | 252/51.5 R X |
| 3,634,515 | 1/1972 | Piasek et al. | 252/51.5 R X |
| 3,697,574 | 10/1972 | Piasek et al. | 252/49.6 X |
| 3,704,308 | 11/1972 | Piasek et al. | 252/49.6 X |
| 3,725,277 | 4/1973 | Worrel | 252/51.5 R |
| 3,736,357 | 5/1973 | Piasek et al. | 252/51.5 R X |
| 3,751,365 | 8/1973 | Piasek et al. | 252/49.6 |
| 3,846,316 | 11/1974 | Schiff et al. | 252/47.5 |
| 3,919,094 | 11/1975 | Schiff | 252/33 |
| 4,011,380 | 3/1977 | West et al. | 252/51.5 R X |
| 4,059,414 | 11/1977 | Holtz et al. | 252/47.5 X |
| 4,131,553 | 12/1978 | West | 252/33 |

FOREIGN PATENT DOCUMENTS

| | | | |
|---|---|---|---|
| 1518283 | 7/1978 | United Kingdom | 252/47.5 |

*Primary Examiner*—Andrew Metz

*Attorney, Agent, or Firm*—James L. Wilson; William T. McClain; William H. Magidson

[57] ABSTRACT

A Mannich condensation reaction of an alkyl phenol, a formaldehyde-yielding reagent, an amine, and about 0.001 to 2.0 moles of an oil soluble benzene sulfonic acid per mole of amine.

6 Claims, No Drawings

BENZENE SULFONIC ACID CATALYZED AROMATIC MANNICH PRODUCTS FROM ALKYL PHENOLS

Aromatic, high molecular weight Mannich additives suitable for lubricants used in four-cycle gasoline or diesel engines are commonly made by the Mannich condensation reaction of an amine, generally a polyamine, a formaldehyde-yielding reagent, and aromatic compound, such as, a high molecular weight alkyl phenol. Mannich additives produced from high molecular weight alkyl phenols are discussed in U.S. Pat. Nos. 3,539,633; 3,697,574; 3,704,308; 3,736,357; and 3,751,365 which are expressly incorporated herein by reference. These Mannich products provide dispersancy to lubricating oils which prevents the formation of harmful deposits derived from oxidized fuel, lubricant, ingested dirt, wear products, etc.

In contrast to aromatic Mannich products made from alkyl phenols, aliphatic Mannich products are commonly prepared from oxidized polymers. These polymers can be oxidized in a variety of ways. West, et al., U.S. Pat. No. 4,011,380, discloses the preparation of oxidized polymers for the aliphatic Mannich reaction. The polymers of ethylene and other olefinic monomers are oxidized in oil solution in the presence of about 0.05 to about 1.0 wt.%, based on the copolymer oil solution, of an oil-soluble benzene sulfonic acid or salt thereof. These oxidized olefinic polymers are used to produce aliphatic high molecular weight Mannich additives produced by the reaction of the oxidized olefinic high molecular weight polymer, a formaldehyde-yielding reagent, and a primary, secondary, or polyamine. The benzene sulfonic acid taught in West enhances the rate of oxidation and often results in a more lightly colored polymer composition.

West, U.S. Pat. No. 4,131,533, discloses alkylbenzene sulfonic acid modified aliphatic Mannich reaction products from oxidized polymers. This patent discloses forming a haze-free Mannich product from an oxidized polymer, formaldehyde, and an amine in the presence of 0.01 to 40.0 wt.%, based on the oil, of an oil-soluble sulfonic acid. The sulfonic acid reduces the formation of hazy products.

Aliphatic Mannich products made from oxidized polymers having bifunctional properties. The polymeric backbone provides viscosity index improvement. Polymers in lubricating oil are kown to provide to the lubricating oil the ability to maintain a higher viscosity than untreated oils at high temperature. The increased viscosity improves the high temperature lubricating property of the oil. In the production of the aliphatic Mannich, the Mannich reaction occurs at carbon atoms alpha to carbonyls produced in the oxidation of the polymer. Each polymer molecule can contain 5–50 carbonyl groups, commonly about 20–30 carbonyl groups, and associated reaction sites. The reaction sites are randomly distributed along the polymer chain. The molecular weights of polymers used to produce the aliphatic Mannich range from about 20,000 to 200,000. Since during oxidation the polymer is degraded, the molecular weight of the polymer can be as low as 5,000. However, the molecular weight generally is in the range of 7,000–55,000.

The aromatic Mannich products, made from alkyl phenols with a molecular weight about 1,000–3,000, provide little viscosity index improvement. The Mannich reaction occurs at a carbon atom ortho to the phenolic hydroxyl. Each alkyl phenol contains two reactive positions. The molecular weight of the Mannich products are commonly from 1,000–2,400. While aromatic Mannich products are high quality dispersants at relatively low concentration, a need continually exists to improve the properties of the Mannich additive.

The general object of the invention is to improve the lubricant properties of the Mannich additive. Another object of the invention is to improve processes for the production of aromatic Mannich products. Further objects appear hereinafter.

We have discovered that an oil-soluble sulfonic acid improves aromatic Mannich product's lubricant properties. The sulfonic acid apparently acts as an acidic catalyst for the reaction of the high molecular weight alkyl phenol, the formaldehyde-yielding compound, and the amine. By catalyzing the reaction, the sulfonic acid promotes a greater utilization of reactants, increased molecular weight, increased nitrogen concentration, increased dispersancy, and reduces the amounts of unreacted or partly reacted compounds in the product.

Briefly, the Mannich additives of this invention are prepared by the reaction of an alkyl phenol, an amine, and formaldehyde in the presence of an oil-soluble benzene sulfonic acid at an elevated temperature.

Certain oil-soluble benzene sulfonic acids useful in this invention for preparing aromatic Mannich additives can have the following general formula:

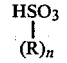

wherein R is hydrogen, an alkyl, aryl, or other hydrocarbyl groups with hydroxy, chloro-, or bromo-substituents; and n is an integer of 1 to 5.

R can be any substantially hydrocarbyl or substituted hydrocarbyl group which results in an oil-soluble benzene sulfonic acid. R can be a hydrogen or a substantially aliphatic group with about 1 to 15 carbon atoms, such as methyl, ethyl, propyl, isopropyl, butyl, t-butyl, nonyl, decyl, dodecyl, pentadecyl and the like, with a molecular weight of about 120 and greater; an intermediate molecular weight alkyl group such as polyisobutylene or polypropylene polymers with 15 to 1,000 carbon atoms with a molecular weight of about 200 to 14,000; a high molecular weight hydrocarbyl such as a polyolefin having a number average molecular weight in excess of 14,000; and others. R can be substituted with groups such as chlorine, bromine, or hydroxy groups. Also, the benzene ring of the sulfonic acid may have more than one substituent, for example, alkyl, hydroxyalkyl, or haloalkyl.

Other suitable oil-soluble benzene sulfonic acids are the oil-soluble, so-called petroleum sulfonic acids which are also commonly referred to as mahogany acids, having a molecular weight from about 350 to 750, aryl sulfonic acids, and alkaryl sulfonic acids. Examples of other suitable sulfonic acids are diparaffin wax-substituted phenol sulfonic acid, cetylchloro benzene sulfonic acid, cetylphenol disulfide sulfonic acid, cetylphenol monosulfide sulfonic acid, etc. Other suitable oil-soluble sulfonic acids are well described in the art such as U.S. Pat. Nos. 2,616,604; 2,626,207; 2,767,209; and others. A most important consideration in selecting either an R group or an alkylbenzene sulfonic acid is that the final sulfonic acid compound must be oil soluble. Low molecular weight oil-soluble sulfonic acids are preferred for the reason that the low molecular weight sulfonic acids are highly oil soluble while excessive amounts of hydrocarbon are not wasted in large substituent groups. The inexpensive, highly active low molecular weight polypropylbenzene sulfonic acids having a molecular weight about 200 to 1,200 are preferred.

Commonly available formaldehyde-yielding reagents can be used in the Mannich additive process. Examples of formaldehyde-yielding reagents are formalin, paraformaldehyde, trioxane, trioxymethylene, other linear formaldehyde oligomers, gaseous formaldehyde, etc.

The amine reactant useful in the preparation of the Mannich products are primary and secondary aliphatic amines and polyamines having the formula $NH_2(CH_2)_yNH_2$, wherein y is an integer of 3 to about 12; polyalkylene polyamines of the general formula $NH_2[(CH_2)_ZNH]_xH$ wherein Z is a number from 2 to 6 and x is an integer from 1 to about 10. Illustrative of suitable amines are methylamine, dibutylamine, cyclohexylamine, propylamine, decylamine, ethylene diamine, trimethylene diamine, tetramethylene diamine, hexamethylene diamine, diethylene triamine, triethylene tetraamine, tetraethylene pentamine, tripropylene tetraamine, tetrapropylene pentamine, and other polyalkylene polyamines in which the alkylene group contains about 12 carbon atoms. Other useful polyamines are bis(amino-propyl)-piperazine, bis(amino-propyl)-ethylene diamine, and bis(amino-propyl)-propylene diamine.

The alkyl phenols useful in this invention for preparing Mannich products are commonly paramonoalkyl-substituted phenols which are made by the reaction of about 1 to 20 moles of phenol with 1 mole of a polyolefin in the presence of an alkylating catalyst. The most common alkylating catalysts are $BF_3$ (including etherate, phenolate, or other complexes, and HF if present), acidic activated clays, or strong ionic exchange resins. The process is particulaly effective when conducted by reacting 3 to 7, or preferably 5, moles of phenol to about 1 mole of polyolefin in the presence of the catalyst. The product is conveniently separated from the catalyst by filtration or decantation. Unreacted phenol is removed by distillation leaving as a residue the product which commonly comprises a paramono-substituted alkyl phenol containing some unreacted polyolefin. Examples of useful polyolefin alkylating agents are polyethylene, poly-1-butene, polyisobutylene, polypropylene, etc., having a molecular weight from about 600 to about 3,200 and greater. These olefinic polymers are well known and can be produced by well-known polymerization of olefins and monomers such as ethene, propene, butene, isobutylene, amylene, etc.

In somewhat greater detail, the Mannich reaction is carried out by the reaction of an amine, a formaldehyde-yielding reagent, and an alkyl phenol in the presence of an effective amount of an oil-soluble benzene sulfonic acid comprising about 0.001 to 2.0 moles of an oil-soluble sulfonic acid per mole of amine. Preferably about 0.01 to 1.0 mole of an oil-soluble sulfonic acid per mole of amine is used to produce a highly active Mannich with low consumption of sulfonic acid. Apparently, the functional group of the oil-soluble sulfonic acid responsible for the improvement in the properties of the Mannich product is the sulfonic acid group which provides acidic catalysis to the Mannich reagent. The high molecular weight products of this invention are preferably prepared by reacting an alkyl phenol with 0.1 to about 10 moles of formaldehyde-yielding reagent, and 0.1 to about 10 moles of amine per mole of phenol. The condensation reaction is performed at a temperature from about ambient (25° C.) to about 160° C. by adding the formaldehyde-yielding reagent to a mixture of the phenol, the polyamine, and the sulfonic acid in an organic inert solvent such as benzene, xylene, toluene, or a solvent-refined mineral oil if needed to reduce viscosity. The reaction temperature can be raised to about 155° C. and held at that temperature until the reaction is complete, about 3 hours. Preferably, at the end of the reaction, the mixture is stripped with an inert gas, such as nitrogen, carbon dioxide, etc., until water produced by the condensation reaction and other volatiles have been removed.

As can be seen above, a wide variety of such oil-soluble sulfonic acids operates to improve the lubricating properties of the Mannich product. The sulfonic acid can be added to the reaction in any convenient manner. The sulfonic acid can be directly added to the reaction neat or in an inert diluent such as a lubricating oil, hexane, benzene, toluene, gasoline, etc. While generally the order of reaction is not of vital importance, the sulfonic acid is commonly added at the same time as or, after the polyamine. When the sulfonic acid is added to the phenol in the reaction mixture with, or after the amine, the sulfonic acid neutralizes the amine and is thus stabilized preventing decomposition of the acid. Often the formaldehyde is added last to further reduce the tendency of the formation of insoluble resinous polyamine and formaldehyde condensation byproducts.

The Mannich reaction is believed to occur between the active or acidic hydrogens on the 2 and 6 positions of the alkyl phenol and the formaldehyde-yielding reagent and a hydrogen bonded to the nitrogen atom of the amine. Since a variety of nitrogen atoms on the amine and positions on the phenol can be involved in the Mannich reaction and many varied cross-linked and aminated compounds can be formed, a very large variety of different Mannich products can occur. The precise chemical composition of the reaction product of the phenol, the amine, and formaldehyde-yielding reagent in the presence of the sulfonic acid cannot be characterized with precise of chemical formulas. The reaction can produce a variety of linked and cross-linked amine-to-phenol reaction products. In view of the complex nature of the reaction product, the precise composition reaction sites and structure of such product cannot be defined by conventional chemical structure but must rather be defined purely through method of preparation and product properties. Chemical reactants which are added at different steps in the production beginning with the addition of the phenol and ending with the addition of the formaldehyde can often produce the unique effects in the chemical and physical properties of the Mannich product. In much the same way, it is impossible to predict with any certainty the chemical properties of the product.

The above-described reaction products of the present invention are effective dispersants in lubricant compositions when used in amounts of from about 0.1 to about 10(wt.)% based on the oil. Suitable lubricating base oils are mineral oils, petroleum oils, synthetic lubricating oils such as those obtained by the polymerization of hydrocarbons and other well-known synthetic lubricating oils, and lubricating oils of animal or vegetable origin. Concentrates of a suitable base oil containing more than 10(wt.)%, by weight at the oil, along or in combination with other well-known additives can be used for blending with the lubricant oil in a proportion designed for particular conditions or used to give finished products containing from about 0.1 to 10 wt.% of the additives of this invention.

The Mannich additives of this invention can be evaluated for dispersancy, varnish prevention, and corrosion prevention by the Spot Dispersancy test, the Hot Tube test, and the Amihot test.

In the Spot Dispersancy test, the ability of the additive in a lubricating oil to suspend and disperse engine sludge is tested. To perform the test, an amount of engine sludge produced in the VC engine test is added to a small amount of lubricant containing the Mannich additive. The sludge and additive are incubated in an oven at 100° F. for 24 hours. After this period the mixture is spotted on a clean blotter paper. The oil diffuses through the blotter paper carrying the sludge to some extent. The dispersancy of the additive is measured by comparing the oil diffusion ring to the sludge diffusion ring. The diameter of the sludge ring is divided by the diameter of the oil ring, the result is multiplied by 100 and is presented as a percent dispersancy.

In the Hot Tube test, the high-temperature, varnish-inhibiting properties of the additive are determined. A measured portion of the lubricating oil containing the Mannich additive is slowly metered into a 2 millimeter glass tube heated in an aluminum block. Through the tube is passed either nitrogen oxides or air at 201.7° C. (3950° F.) or 257.2° C. (495° F.). During the test, the oil is consumed, and the ability of the additive to prevent the formation of varnish deposits is measured by the ability of the additive to prevent the formation of colored deposits on the interior surface of the tube. The tube is rated from 10 to 1 wherein 10 is perfectly clean and colorless and 1 is opaque and black.

In the Amihot test, bearing material containing copper and lead is placed in a tube containing a portion of lubricating oil containing the Mannich product. To the oil is added a small amount of corrosive material such as hydrochloric acid. The lubricant and bearing material are heated in the tube to a temperature of about 162.8° C. (325° F.), and air is passed through the tube. The bearing is weighed prior to immersion in the oil, and at the end of the test, the bearing is cleaned in solvent and reweighed. The ability of the additive to prevent corrosion of the bearing is reflected in the loss of weight of the bearing. The smaller the weight loss, the better the additive in preventing acid corrosion.

The benzene sulfonic acid improves the dispersancy, the ability to prevent varnish deposits and the ability to prevent corrosion of engines of the Mannich products. These results are achieved as a consequence of the homogeneous acid catalysis provided by the sulfonic acid which produces a more highly polymerized product, having increased molecular weight and increased nitrogen content.

The following examples are illustrative of methods for the preparation of the sulfonic acid modified Mannich product. The Examples should not be used to limit the scope of the invention.

EXAMPLE I

Into a one-liter, three-neck flask equipped with a reflux condenser, thermostat, Dean-Starke trap, thermometer, and nitrogen purge tube, was charged 230 grams (0.069 mole) of a 60% active polybutyl phenol molecular weight about 2000 in 5W oil, 5.6 grams (0.019 mole) of oleic acid, 5.3 grams (0.01 mole) of alkylbenzene sulfonic acid, and 10.6 grams (0.05 mole) of TEPA. The mixture was stirred and heated to a temperature of about 62° C. (144° F.). To the mixture was added 8.4 milliliters (0.025 mole) of formaldehyde. The temperature was raised to 320° F. and held for two hours. Eight grams (0.025 mole of formaldehyde) of paraformaldehyde was added at 320° F. for a period of 24 minutes. After the addition of the paraformaldehyde, the temperature was maintained between 310° F. and 320° F. for an additional 2 hours. At the end of this period, the mixture was stripped of water and other volatile materials by a heated nitrogen stream at one cubic foot per hour. The mixture was cooled and was ready for use. The product was crystal clear.

EXAMPLE II

Example I was repeated except 10.6 grams (0.037 mole) of oleic acid was added to the reaction mixture in place of the 5.3 grams (0.019 mole) of oleic acid and the 5.3 (0.010 mole) grams of the alkylbenzene sulfonic acid.

TABLE I

BENCH TEST OF SULFONIC ACID MODIFIED MANNICH

| | PRODUCT OF EXAMPLE I | PRODUCT OF EXAMPLE II |
|---|---|---|
| Spot Dispersancy (100 = perfect) | | |
| Neat[1] | 98 | 85 |
| Ash[2] | 91 | 59 |
| Hot Tube (10 = perfect) | 7 | 5 |
| Amihot, mg BWL (0.0 = perfect) | −9.9 | −10.6 |

[1]5% product[2]4% product + 6% overbased Ca sulfonate + 1% Zn dialkyl dithiophosphate Table I shows that the sulfonic acid modified product of Example I has increased dispersancy, increased varnish prevention activity and slightly increased corrosion protection, when compared to the unmodified Mannich product.

Sulfonic acid modification not only improves the lubricating properties of the additive and the initial product clarity but also stabilizes product clarity during storage. Thus, product which would be expected to develop haze when stored at 160° F. for several weeks, was still bright and clear after five months storage with 0.4% alkylbenzene sulfonic acid. The sulfonic acid need not be added during manufacture to achieve stabilization. Benzene sulfonic acid added to manufactured product improved storage stability as shown below. One of the commercial samples, dated 2/20, even clarified on initial blending with the sulfonic acid spike.

TABLE II

| Commercial Mannich Product Daily Composite | Clarity (5 months, 160° F.)[1] Untreated | Treated (0.4%) |
|---|---|---|
| 2/20 | 5 (10 = max) | 7− |
| 5/8 | 7− | 7 |
| 5/12 | 5 | 5 |
| 7/23 | 6 | 7 |
| 7/27 | 5 | 5+ |

[1]7 = crystal clear, 5 = minimum clarity

Table II shows the ability of the sulfonic acid to prevent haze formation when added to the reaction product of the alkyl phenol, formaldehyde reagent, and the amine after the reaction producing the Mannich product.

TABLE III

| COMPARISON OF MOLECULAR WEIGHT OF PRODUCTS | | |
|---|---|---|
| | PRODUCT EXAMPLE II | PRODUCT EXAMPLE I |
| $\overline{M}n$ | 1044 | 1119 |
| Calc'd Activity | 47.9% | 47.4% |
| Calc'd Act. Ing. $\overline{M}n$ | 2528 | 3785 |
| Theoretical Monomer $\overline{M}n$ (Act. Ing.) | 2679 | 2626 |
| Polymerization Extent | 0.94 | 1.44 |

Table III provides some basis to explain why the sulfonic acid appears to improve the lubricating properties of the Mannich. If the sulfonic acid operates as a homogeneous acidic catalyst to promote the Mannich reaction, one indication that the reaction is catalyzed is the increased molecular weight of the products. Table III shows that the extent of polymerization of the sulfonic acid modified product of Example I is greater than that of the unmodified product of Example II.

The foregoing specification is illustrative of the invention. Since many embodiments of the invention can be made the invention resides in the claims hereinafter appended.

I claim:

1. A process for producing an improved aromatic Mannich product having enhanced lubricating properties which comprises reacting an alkyl phenol wherein the alkyl group is derived from a polyolefin having a molecular weight about 600–3200, a formaldehyde-yielding reagent, an aliphatic amine of the general formula $NH_2[(CH_2)_zNH]_xH$ wherein z is an integer from about 2 to about 6 and x is an integer from about 1 to about 10 and about 0.001 to 2.0 moles of an oil-soluble benzene sulfonic acid per mole of amine.

2. The process of claim 1 wherein the oil-soluble sulfonic acid is an alkyl benzene sulfonic acid.

3. The process of claim 2 wherein the molecular weight of the alkyl benzene sulfonic acid is about 200 to 14,000.

4. The process of claim 3 wherein the oil-soluble sulfonic acid is a polypropylbenzene sulfonic acid of a number average molecular weight about 200 to 1,200.

5. The process of claim 1 wherein about 0.01 to 1.0 mole of benzene sulfonic acid is present per mole of amine in the reaction.

6. A lubricant oil containing about 0.1 to 10 (wt)% based on the oil of the product of the process of claim 1.

* * * * *

UNITED STATES PATENT OFFICE

CERTIFICATE OF CORRECTION

Patent No. 4,425,249 Dated JANUARY 10, 1984

Inventor(s) PAUL J. CAHILL and EDMUND J. PIASEK

It is certified that error appears in the above-identified patent and that said Letters Patent are hereby corrected as shown below:

| | |
|---|---|
| Column 1, line 47, | "having" should be --have--. |
| Column 1, line 49, | "kown" should be --known--. |
| Column 3, line 65, | "reagent" should be --reaction--. |
| Column 4, line 67, | "along" should be --alone--. |
| Column 5, line 47, | "loss," should be --loss is,--. |
| Column 5, line 47, | "the better the" should be --the better is the--. |
| Column 6, line 20, | "5.3 (0.010 mole) grams" should be --5.3 grams (0.010 mole)--. |
| Column 8, line 1, | "made the" should be --made, the--. |

Signed and Sealed this

*Eleventh* Day of *September 1984*

[SEAL]

*Attest:*

*Attesting Officer*

GERALD J. MOSSINGHOFF

*Commissioner of Patents and Trademarks*